US006931760B2

(12) United States Patent
Yang

(10) Patent No.: US 6,931,760 B2
(45) Date of Patent: Aug. 23, 2005

(54) DRYER CONTROL METHOD AND APPARATUS USING THE SAME

(75) Inventor: Jae Suk Yang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/887,092

(22) Filed: Jul. 9, 2004

(65) Prior Publication Data

US 2005/0091876 A1 May 5, 2005

(30) Foreign Application Priority Data

Nov. 3, 2003 (KR) ..... 10-2003-77290

(51) Int. Cl.[7] ..... F26B 3/00

(52) U.S. Cl. ..... 34/491; 34/494; 34/528; 307/650

(58) Field of Search ..... 34/491, 494.5, 34/28, 575, 606; 307/650; 134/93; 68/17 R

(56) References Cited

U.S. PATENT DOCUMENTS 4,206,552 A * 6/1980 Pomerantz et al. ..... 34/445
4,385,452 A * 5/1983 Deschaaf et al. ..... 34/562
5,367,265 A * 11/1994 Gaudette ..... 307/650
5,899,005 A * 5/1999 Chen et al. ..... 34/528
6,079,121 A * 6/2000 Khadkikar et al. ..... 34/528

* cited by examiner

*Primary Examiner*—Stephen Gravini
(74) *Attorney, Agent, or Firm*—McKenna Long & Aldridge LLP

(57) ABSTRACT

A dryer control method provides for selection among a plurality of dryness levels so that the user may select a desired degree of dryness for any given type of laundry. The method includes steps of selecting one among a plurality of dryness levels; driving a drying unit holding laundry; sensing a value indicative of a water content of the laundry; comparing the sensed value with first and second predetermined values; measuring a time required for the sensed value to reach the second predetermined value from the first predetermined value; computing a drying time based on the measured time; and stopping the driving step upon expiration of the computed drying time, wherein the first and second predetermined values determine a reference value corresponding to the selected dryness level.

15 Claims, 2 Drawing Sheets

DRYER CONTROL METHOD AND APPARATUS USING THE SAME

This application claims the benefit of Korean Application No. P2003-077290, filed on Nov. 3, 2003, which is hereby incorporated by reference.

BACKGROUND OF THE INVENTION

1. Field of the Invention

The present invention relates to automatic dryers, and more particularly, to a dryer control method and apparatus using the same, in which an algorithm enables the drying of laundry according to laundry type and a degree of dryness selected by the user.

2. Discussion of the Related Art

Generally speaking, an automatic dryer is an apparatus using an electric heater to dry wet laundry automatically when the wet laundry is placed in a rotatable drum. After a selection of a drying operation, the selected drying operation is started by a user. The drum holding the wet laundry is then driven by an electric motor linked via a drum belt to the drum and a blower fan, each of which are driven according to an algorithm stored in a memory. The drying operation is controlled by a controller which drives a drying unit comprising the drum, the motor, the heater, and the fan. The fan forces heated air onto the wet laundry rotating within the drum, such that external air is heated by the heater and is forced through a circulation duct, to pass over the wet laundry and be discharged from the interior of the drum. The laundry is dried as the laundry's water content exits the dryer via a condensed water duct.

In the operation of a contemporary dryer as described above, a timer is typically used to determine the time (duration) for driving the drying unit. In doing so, however, it is difficult to ascertain a proper duration for every type of laundry, including a variety of clothing and household fabrics, i.e., cotton, wool, silk, polyesters, etc. If a set time is used for all types, the laundry may be damaged during the drying operation.

To overcome this problem, a moisture sensor may be incorporated to achieve dryness based on the laundry's water content. The user may, however, desire a predetermined degree of dryness, such as "damp" or "fully dry." In such cases, it is still difficult to ascertain the proper duration for every type of laundry, whereby the laundry may be damaged during the drying operation or the dryer fails to reach the desired degree of dryness for a given type of laundry. In any case, the contemporary dryer fails to achieve optimally drying.

SUMMARY OF THE INVENTION

Accordingly, the present invention is directed to a dryer control method and apparatus that substantially obviate one or more of the problems due to limitations and disadvantages of the related art.

An object of the present invention, which has been devised to solve the foregoing problem, lies in providing a dryer control method, which enables selection of a degree of dryness, to optimally dry laundry.

Another object of the present invention is to provide a dryer control method, which enables optimal drying of laundry based on laundry type and a user selection of a degree of dryness.

Another object of the present invention is to provide a dryer control method, by which an algorithm enables laundry to be automatically dried based on laundry type and a controllable degree of dryness.

Another object of the present invention is to provide an apparatus suitable for achieving the above methods.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dryer control method comprising steps of driving a drying unit holding laundry; sensing a value indicative of a water content of the laundry; comparing the sensed value with first and second predetermined values; measuring a time required for the sensed value to reach the second predetermined value from the first predetermined value; computing a drying time based on the measured time; and stopping the driving step upon expiration of the computed drying time. Preferably, the method further comprises a step of selecting one among a plurality of dryness levels, wherein the first and second predetermined values determine a reference value corresponding to the selected dryness level. The drying time is computed by an equation $t=C_1+C_2\Delta T$, where t is the drying time, $C_1$ is an arbitrary constant, $C_2$ is a constant according to dryness level, and $\Delta T$ is the measured time.

In another aspect of the present invention, there is provided an automatic dryer comprising a drying unit for holding and drying laundry; a sensor for sensing a water content of the laundry and outputting a value indicative of the sensed water content of the laundry; and a controller for controlling the drying unit according to a measured time, wherein the measured time is a time required for the value output from the sensor to rise by a reference amount. Preferably, the dryer further comprises a timer, controlled by the controller, for measuring the measured time; and a memory for storing a lookup table for storing a plurality of reference values respectively corresponding to the plurality of selectable dryness levels.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

According to the present invention, a user may select from a plurality of dryness levels or degrees of desired dryness and may select from a plurality of laundry types. In a preferred embodiment, the degrees of desired dryness include four levels of increasing dryness for each type of laundry, with the highest degree of each type of laundry allowing for no further drying. Such levels may include "damp," "less," "dry," and "fully dry" for each type of laundry (cotton, wool, silk, polyester, etc.), and for a given laundry type, the user selects a desired degree of dryness from an appropriately labeled input panel.

Figure 1:
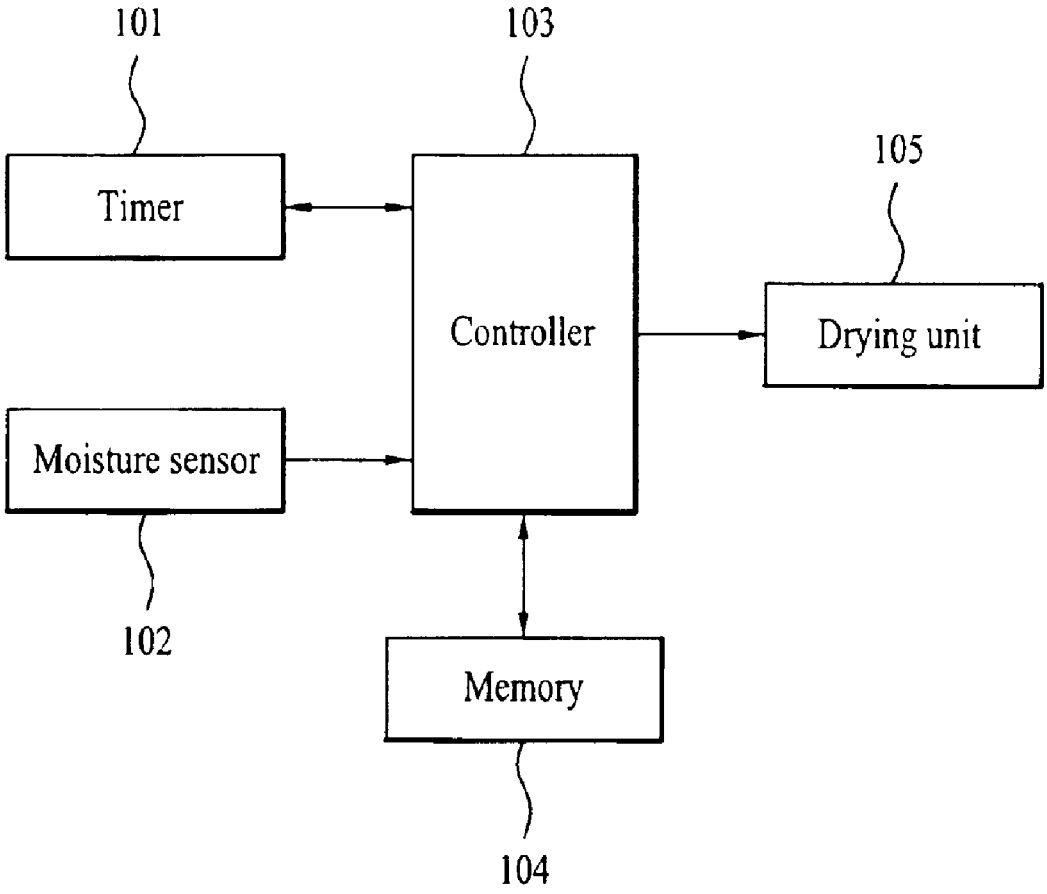
FIG. 1 is a block diagram of an automatic dryer according to the present invention.

Referring to FIG. 1, an automatic dryer according to the present invention comprises a timer 101, a moisture sensor 102, a controller 103, a memory 104, and a drying unit 105. The moisture sensor 102 senses a level of water content present in the laundry being dried and outputs a voltage (e.g., a linear value ranging from 0V to 5V) corresponding to the sensed level. The voltage value is used for computing a drying time of the laundry.

As the drying operation proceeds, the output voltage of the moisture sensor 102 begins to rise and is periodically compared to a reference value of a lookup table stored in the memory 104. The reference value is based on first and second predetermined voltages. Beginning from a point where the output voltage of the moisture sensor 102 reaches the first predetermined voltage, the controller 103 uses the timer 101 to measure the time taken for the output voltage to reach the second predetermined voltage. Thus, the measured time ($\Delta T$) is the time taken for the output voltage of the moisture sensor 102 to rise by a reference amount (voltage) and is used to compute a drying time (t) corresponding to a selected dryness level. The controller 103 then controls the drying unit 105 to dry the laundry according to the computed drying time.

The drying time is computed by $t=C_1+C_2\Delta T$, where $C_1$ is an arbitrary constant and $C_2$ is a constant corresponding to the selected dryness level per laundry type. Here, the arbitrary constant $C_1$ acts as an offset and may be assumed to be equal to zero.

The following table is an example format of the lookup table of the memory 104, in which a reference voltage is stored according to dryness levels and constants are stored according to dryness levels and laundry type. The lookup table may also contain respective sets of $C_1$ values.

| laundry type | selected dryness | reference voltage | $C_2$ |
|---|---|---|---|
| cotton | damp | $Ref_1$ | $cottonC_{2damp}$ |
| | less | $Ref_2$ | $cottonC_{2less}$ |
| | dry | $Ref_3$ | $cottonC_{2dry}$ |
| | fully dry | $Ref_4$ | $cottonC_{2fully_dry}$ |
| wool | damp | $Ref_1$ | $woolC_{2damp}$ |
| | less | $Ref_2$ | $woolC_{2less}$ |
| | dry | $Ref_3$ | $woolC_{2dry}$ |
| | fully dry | $Ref_4$ | $woolC_{2fully_dry}$ |
| silk | damp | $Ref_1$ | $silkC_{2damp}$ |
| | less | $Ref_2$ | $silkC_{2less}$ |
| | dry | $Ref_3$ | $silkC_{2dry}$ |
| | fully dry | $Ref_4$ | $silkC_{2fully_dry}$ |
| polyester | damp | $Ref_1$ | $polyesterC_{2damp}$ |
| | less | $Ref_2$ | $polyesterC_{2less}$ |
| | dry | $Ref_3$ | $polyesterC_{2dry}$ |
| | fully dry | $Ref_4$ | $polyesterC_{2fully_dry}$ |

In the operation of the automatic dryer as described above, the user first selects a dryness level according to laundry type and then presses a "start" button (not shown) to initiate the selected drying operation. Based on the operational selections and a stored program, the controller 103 controls the entire drying operation automatically.

Figure 2:
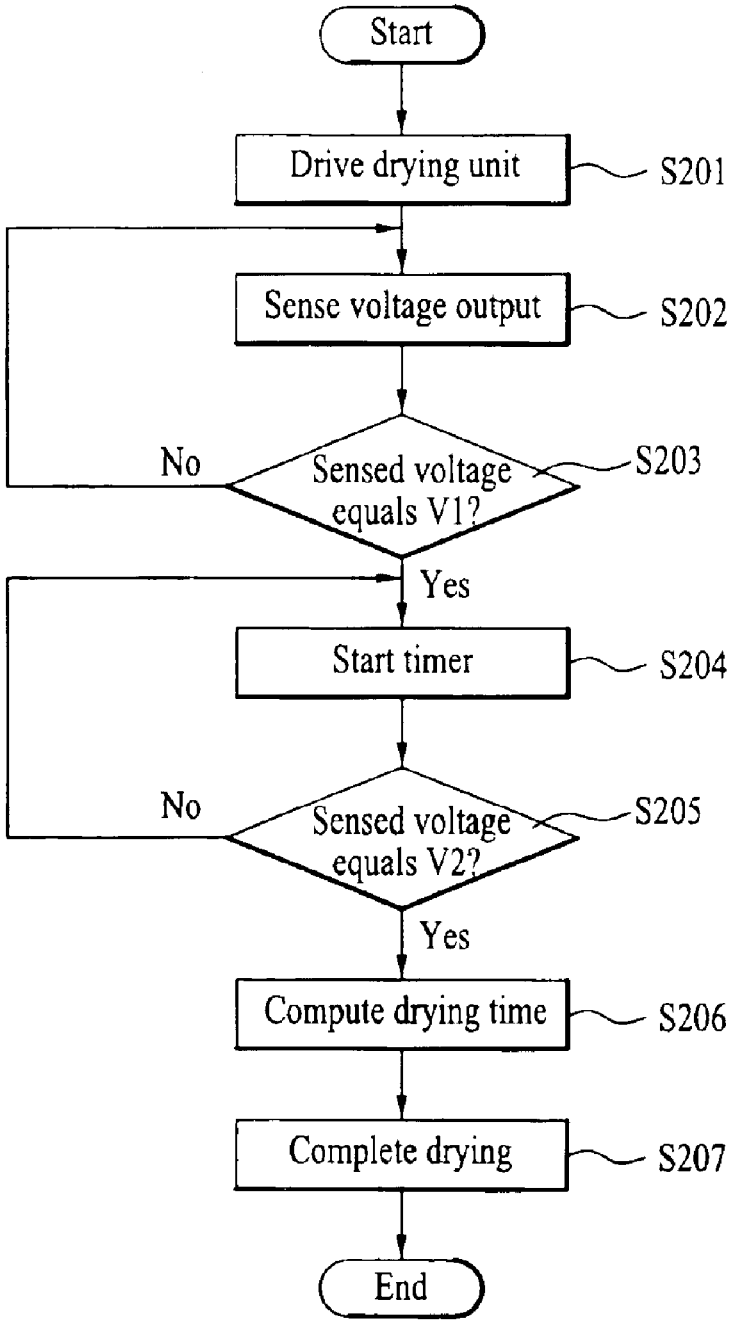
FIG. 2 is a flowchart of a dryer control method according to the present invention.

FIG. 2 illustrates a dryer control method according to the present invention, in which the controller 103 executes the stored program upon activation of the start button, whereby the drying unit 105 is driven in a step S201. While the drying unit is being driven, the controller 103 monitors (periodically detects) the output voltage of the moisture sensor 102 through steps S202 and S203, to determine whether the output voltage reaches the first predetermined voltage (V1), at which time the timer 101 is begun. Then, through steps S204 and S205, the time taken for the output voltage of the moisture sensor 102 to reach the second predetermined voltage (V2) is measured. Upon reaching the second predetermined voltage the measured time $\Delta T$ can be known.

As the drying unit 105 is continuously driven by the controller 103, the water content of the laundry continues to drop, and the output voltage of the moisture sensor 102 continues to rise. In other words, removing the water content of the laundry as detected by the moister sensor 102 causes the output voltage of the moisture sensor 102 to rise and thereby surpass the stored reference voltage ($Ref_1$, $Ref_2$, $Ref_3$, or $Ref_4$), which is set according to the desired degree of dryness and represents the time required to dry the laundry to one of the available dryness levels. Once the measured time $\Delta T$ is obtained through the above process, the drying time t is computed in a step S206, according to the selected dryness level and laundry type. The drying operation is completed in a step S207 by continuing to drive the drying unit 105 until the computed time expires.

By adopting the dryer control method and apparatus of the present invention, a plurality of dryness levels may be provided, so that the user may select a desired degree of dryness for any given type of laundry. Though four dryness levels are illustrated in the preferred embodiment, it should be appreciated that the dryness levels may be arranged according to any type of laundry as desired, to thereby provide for optimal drying for a variety of conditions without damaging the laundry.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dryer control method comprising steps of:

driving a drying unit which holds laundry;

sensing a value indicative of a water content of the laundry;

determining whether the sensed value reaches a first predetermined value;

measuring an amount of time required for the sensed value to reach a second predetermined value from the first predetermined value;

computing a drying time based on the measured time; and stopping said driving step upon expiration of the computed drying time.

2. The dryer control method as claimed in claim 1, further comprising a step of selecting a dryness level, wherein the first and second predetermined values determine a reference value corresponding to the selected dryness level.

3. The dryer control method as claimed in claim 2, wherein the drying time is computed by an equation $t=C_1+C_2\Delta T$, where t is the drying time, $C_1$ is a constant, $C_2$ is a constant according to a dryness level, and $\Delta T$ is the measured time.

4. The dryer control method as claimed in claim 3, wherein the constant $C_1$ is an offset value.

5. The dryer control method as claimed in claim 4, wherein the offset value is zero.

6. The dryer control method as claimed in claim 2, wherein the dryness level is selected according to laundry type.

7. An automatic dryer comprising:

a drying unit for holding and drying laundry;

a sensor for sensing a water content of the laundry and outputting a value indicative of the sensed water content of the laundry; and a controller configured to control said drying unit according to a measured amount of time, wherein the measured time is a time required for said sensor output value to rise by a reference amount.

8. The automatic dryer as claimed in claim 7, wherein the reference amount corresponds to one of a plurality of selectable dryness levels.

9. The automatic dryer as claimed in claim 8, further comprising:

a timer, controlled by said controller, for measuring the measured time; and a memory for storing a lookup table which stores a plurality of reference values corresponding to the plurality of selectable dryness levels.

10. The automatic dryer as claimed in claim 9, wherein the lookup table further stores a dryness constant $C_2$ corresponding to one of the plurality of selectable dryness levels.

11. The automatic dryer as claimed in claim 10, wherein the dryness constant is stored according to a laundry type.

12. The automatic dryer as claimed in claim 11, wherein the lookup table further stores an arbitrary constant $C_1$ indicative of an offset for each laundry type.

13. The automatic dryer as claimed in claim 7, wherein said drying unit comprises:

a rotatable drum for holding the laundry;

an electric heater for heating external air and forcing the heated air inside said rotatable drum;

a blower fan for circulating the air of the drum; and an electric motor for rotating said blower fan and said rotatable drum.

14. The automatic dryer as claimed in claim 7, wherein said sensor is a moisture sensor.

15. The automatic dryer as claimed in claim 7, wherein said sensor outputs a linear voltage value from 0V to 5V indicative of a water content of the laundry.

* * * * *